US005273569A

United States Patent [19]

Gilman et al.

[11] Patent Number: 5,273,569

[45] Date of Patent: Dec. 28, 1993

[54] MAGNESIUM BASED METAL MATRIX COMPOSITES PRODUCED FROM RAPIDLY SOLIDIFIED ALLOYS

[75] Inventors: Paul S. Gilman, Suffern, N.Y.; Michael S. Zedalis, Randolph, N.J.

[73] Assignee: Allied-Signal Inc., Morris Township, Morris County, N.J.

[21] Appl. No.: 433,829

[22] Filed: Nov. 9, 1989

[51] Int. Cl.[5] ..... C22C 29/00

[52] U.S. Cl. ..... 75/230; 75/232; 75/236; 75/243; 428/614; 148/420

[58] Field of Search ..... 428/614; 148/420; 75/230, 232, 336, 243; 164/97

[56] References Cited

U.S. PATENT DOCUMENTS

| | | | |
|---|---|---|---|
| 3,942,511 | 3/1976 | Black et al. | 126/248 |
| 3,993,577 | 11/1976 | Black et al. | 252/188 |
| 4,017,414 | 4/1977 | Black et al. | 252/188 |
| 4,056,874 | 11/1977 | Kalnin | 148/420 |
| 4,264,362 | 4/1981 | Sergev et al. | 75/243 |
| 4,318,438 | 3/1982 | Ban et al. | 164/97 |
| 4,492,265 | 1/1985 | Donomoto et al. | 164/493 |
| 4,613,386 | 9/1986 | Yates et al. | 148/420 |
| 4,675,157 | 6/1987 | Das et al. | 420/408 |
| 4,765,954 | 8/1988 | Das et al. | 420/408 |
| 4,767,678 | 8/1988 | Yates et al. | 148/420 |
| 5,143,795 | 9/1992 | Das et al. | 428/614 |

*Primary Examiner*—Stephen J. Lechert, Jr.
*Assistant Examiner*—Ngoclan T. Mai
*Attorney, Agent, or Firm*—Ernest D. Buff; Gerhard H. Fuchs

[57] ABSTRACT

A composite has a magnesium base metal matrix and a reinforcing phase. The composite is produced from a charge containing a rapidly solidified magnesium base alloy and particles of a reinforcing material present in an amount ranging from about 0.1 to 50 percent by volume of the charge. Ball milling the charge energetically enfolds metal matrix material around each of the particles, while maintaining the charge in a pulverant state. Consolidation of the charge provides a mechanically formable, substantially void-free mass.

7 Claims, 4 Drawing Sheets

MAGNESIUM BASED METAL MATRIX COMPOSITES PRODUCED FROM RAPIDLY SOLIDIFIED ALLOYS

BACKGROUND OF THE INVENTION

1. Field of the Invention

This invention relates to a process for improving the mechanical properties of metal, and particularly to a process for producing a magnesium composite having a rapidly solidified metal matrix and a reinforcing phase.

2. Description of the Prior Art

A magnesium based composite generally comprises two components—a magnesium alloy matrix and a hard reinforcing second phase. The composite typically exhibits at least one characteristic reflective of each component. For example, a magnesium based metal matrix composite should have the low density of the magnesium matrix and the high elastic modulus of the reinforcing phase. Magnesium based metal matrix composites fabricated to date are made by mixing a reinforcing phase with molten magnesium and then ingot casting. This technique does provide a composite, but the mixing technique employed does not result in a uniform distribution of reinforcement, and is limited by the mechanical and physical properties of the magnesium based alloy matrix. As a result, the mechanical properties may be anisotropic and the composite itself may demonstrate poor corrosion resistance. It has been proposed that these techniques and associated limitations be avoided by solid state bonding/mixing (e.g., mechanically alloying) the matrix with the addition of the particular reinforcement. This procedure permits the reinforcing phase to be mixed and bonded to the matrix without heating the material to a temperature above the solidus of the matrix. Prior processes in which magnesium based alloys and/or metal matrix composites are mechanically alloyed by means of solid state bonding are disclosed in U.S. Pat. Nos. 4,264,362, 4,017,414, 3,993,577 and 3,942,511. In those processes intimate mixing of magnesium with various elemental additions by mechanical alloying was utilized to create micro electrochemical cells for the purpose of promoting corrosion without regard to the mechanical integrity of the final product form. The present invention provides a material having enhanced mechanical properties and improved corrosion resistance.

SUMMARY OF THE INVENTION

The present invention provides a process for producing a magnesium base alloy matrix composite having improved mechanical properties, i.e., modulus and corrosion resistance. Briefly stated, the process comprises the steps of forming a charge containing, as ingredients, a rapidly solidified magnesium alloy and particles of a reinforcing material such as hard carbide, oxide, boride, carboboride, nitride or a hard intermetallic compound, the reinforcing material being present in an amount ranging from about 0.1 to 50 percent by volume of the charge, and ball milling the charge energetically to enfold metal matrix material around each of the reinforcing particles while maintaining the charge in a pulverulent state. In this manner there is provided a strong bond between the matrix material and the surface of the reinforcing particles, as well as a uniform dispersion of the reinforcing particles therewithin. Upon completion of the ball milling step, the resultant powder is hot pressed or sintered using conventional powder metallurgical techniques, to form a powder compact having a mechanically formable, substantially void-free mass. The compressed and treated powder compact is then mechanically worked to increase its density and provide engineering shapes suitable for use in aerospace components such as antenae, sabots, automotive components such as wheels, rims and connecting rods, and miscellaneous items such as bicycle components, tennis & racketball rackets, ladders, and the like.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

Figure 1A:
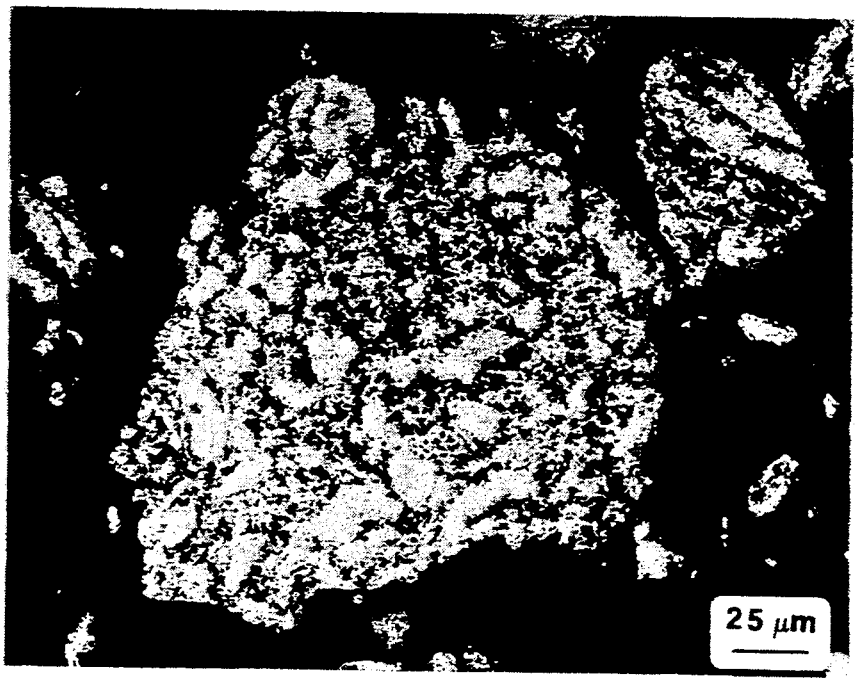
FIGS. 1A and 1B are photomicrographs of rapidly solidified magnesium based aluminum, zinc and neodymium containing alloy powder having about 5 and 15 percent by volume silicon carbide particles substantially uniformly distributed therein in accordance with the present invention.

In accordance with the present invention nominally pure magnesium is alloyed with about 0 to 11 atom percent aluminum, about 0 to 4 atom percent zinc, about 0.5 to 4 atom percent of at least one element selected from the group consisting of silicon, germanium, cobalt, tin and antimony, the balance being magnesium and incidental impurities, with the proviso that the sum of aluminum and zinc present ranges from about 2 to 13 atom percent. The alloys are melted in a protective environment, and quenched in a protective environment at a rate of at least about $10^{5}$° C./sec by directing the melt into contact with a rapidly moving chilled surface to form thereby a rapidly solidified ribbon. Such alloy ribbons have high strength, and high hardness (i.e., microVickers hardness of at least about 125 kg/mm$^2$). When the alloy constituent aluminum is alloyed without the addition of zinc, the minimum aluminum content is preferably above about 6 atom percent. In the alloys discussed above up to 4 atom percent of the aluminum and zinc present is replaced by at least one element selected from the group consisting of neodymium, praseodymium, yttrium, cerium and manganese. In addition, up to 0.3 atom percent of silicon, germanium, cobalt, tin and antimony present in the alloy is replaced by zirconium. The alloys of the present invention have a very fine microstructure which is not resolved by optical microscopy. Transmission electron microscopy reveals a substantially uniform cellular network of solid solution phase ranging from 0.2 to 1.0 microns in size, together with precipitates of very fine, binary or ternary intermetallic phases which are less than 0.5 microns and composed of magnesium and other elements added in accordance with the invention.

The rapidly solidified microstructure, solidified at rates in excess of $10^5$° C./sec, is responsible for high hardness ranging from about 150–200 kg/mm$^2$. The high hardness is retained after annealing at a temperature of 200° C. for times up to 100 hours. This is because the intermetallic phases such as $Mg_2Si$ and $Mg_2Ge$ are quite stable and do not coarsen appreciably at temperatures up to 250° C. The as-cast ribbon or sheet is typically 25 to 100 microns thick. The rapidly solidified materials of the above described compositions are sufficiently brittle to permit them to be mechanically comminuted by conventional apparatus, such as a ball mill, knife mill, hammer mill pulverizer, fluid energy mill, or the like. Depending on the degree of pulverization to which the ribbons are subjected, different particle sizes are obtained. Usually the powder is comprised of platelets having an average thickness of less than 100 microns. These platelets are characterized by irregular shapes resulting from fracture of the ribbon during comminution. The magnesium matrix material must be provided as a particulate that can range in size from 0.64 cm in diameter to less than 0.0025 cm in diameter.

For the purposes of this application and claims, the term "hard", as applied to particles which may form the reinforcing phase of the resultant composite shall generally imply (1) a scratch hardness in excess of 8 on the Ridgway's Extension of the MOH's Scale of Hardness, and (2) an essentially nonmalleable character. However, for the magnesium matrices of this invention somewhat softer reinforcing particles such as graphite particles may be useful. Hard particles useful in the process of this invention include filamentary or non-filamentary particles of silicon carbide, aluminum oxide and/or aluminum hydroxide, magnesium oxide, magnesium aluminum oxide and/or magnesium hydroxide (including additions thereof due to its formation on the surface of the magnesium matrix material), zirconia, garnet, cerium oxide, yttria, aluminum silicate, magnesium silicate, including silicates modified with fluoride and hydroxide ions, silicon nitride, boron nitride, boron carbide, simple or mixed carbides, borides, carboborides and carbonitrides of tantalum, tungsten, zirconium, hafnium and titanium, and magnesium-base intermetallic compounds such as $Mg_2Si$, $Mg_2Ge$, $Mg_2Sn$, $Mg_2Sb_3$, $MgCo_2$, $Mg_{17}Al_{12}$ and MgZn. In particular, because the present invention is concerned with magnesium based composites that possess a low density, low coefficient of thermal expansion and high modulus, silicon carbide, silicon nitride, boron carbide, boron nitride and graphite are desirable as the reinforcing phase. However, other particulate reinforcements may prove to form superior matrix/reinforcement bonds. Also, the present specification is not limited to single types of reinforcement or single phase matrix alloys.

The ability to process a fine and uniform dispersion of the reinforcing phase into the magnesium matrix is a direct consequence of starting with rapidly solidified magnesium alloys. Rapid solidification of those alloys is accomplished in numerous ways, including planar flow or jet casting methods, melt extraction, splat quenching, atomization techniques and plasma spray methods. The term "energetic ball milling" in the context of the present specification and claims means milling at prescribed conditions where the energy intensity level is such that the hard reinforcing phase is optimately kneaded into the magnesium matrix. As used herein, the phrase "prescribed conditions" means conditions such that the ball mill is operated to physically deform, cold weld and fracture the matrix metal alloy powder so as to distribute the reinforcing phase therewithin. The phrase "optimately kneaded", as used herein, means that the reinforcing phase is distributed more uniformly than the distribution produced by simple mixing or blending, and approaches a substantially uniform and, most preferably, a substantially homogeneous distribution of reinforcing material within the matrix. Energetic ball mills include vibratory mills, rotary ball mills and stirred attritor mills. This invention alloys for milling to be performed with or without the addition of a processing aid, i.e., organic waxes such as stearic acid. The requirement of a processing aid may be dependent on the type and material of the ball mill and will prevent cold welding of matrix particles into large agglomerates or to the side of the milling container or balls.

After reinforcement is completed, the resultant powder may be consolidated into fully dense bulk parts by known techniques such as hot isostatic pressing, hot rolling, hot extrusion, hot forging, cold pressing followed by sintering, etc., the conditions being such that no significant melting of the matrix occurs. Generally, the consolidation step is carried out at a temperature ranging from about 20° C. to 400° C., and preferably from about 200° C. to 300° C., the temperature being below the solidus temperature of the metal matrix. The Mg base matrix composite containing silicon carbide reinforcement may be canless vacuum hot pressed at a temperature ranging from about 150° C. to 300° C. and more preferably from 200° C. to 275° C., followed by extrusion and/or forging. The microstructure obtained after consolidation depends upon the composition of the alloy and the consolidation conditions. Excessive times at high temperatures can cause the fine precipitates to coarsen beyond the optimal submicron size, leading to a deterioration of the properties, i.e., a decrease in hardness and strength.

Those skilled in the art will appreciate that other time/temperature combinations may be used and that other variation in pressing and sintering may be employed. For example, instead of canless vacuum hot pressing, the powder may be placed in a metal can, such as aluminum or magnesium cans having a diameter as large as 30 cm or more, hot degassed in the can, sealed therein under vacuum, and thereafter reheated within the can and compacted to full density, the compacting step being conducted, for example, in a blind died extrusion press. In general, any technique applicable to the art of powder metallurgy which does not invoke liquefying (melting) or partially liquefying the matrix metal may be used. Representative of such techniques are explosive compaction, cold isostatic pressing, hot isostatic pressing and direct powder extrusion. The resultant billet can then be worked into structural shapes by forging, rolling, extrusion, drawing and similar metal working operations.

EXAMPLE I

Three gram samples of −40 mesh (U.S. standard sieve) powder of the composition magnesium-balance, 3.26 at % Al (3.35 wt. % Al), 1.53 at % Zn (3.8 wt. %

Figure 1B:
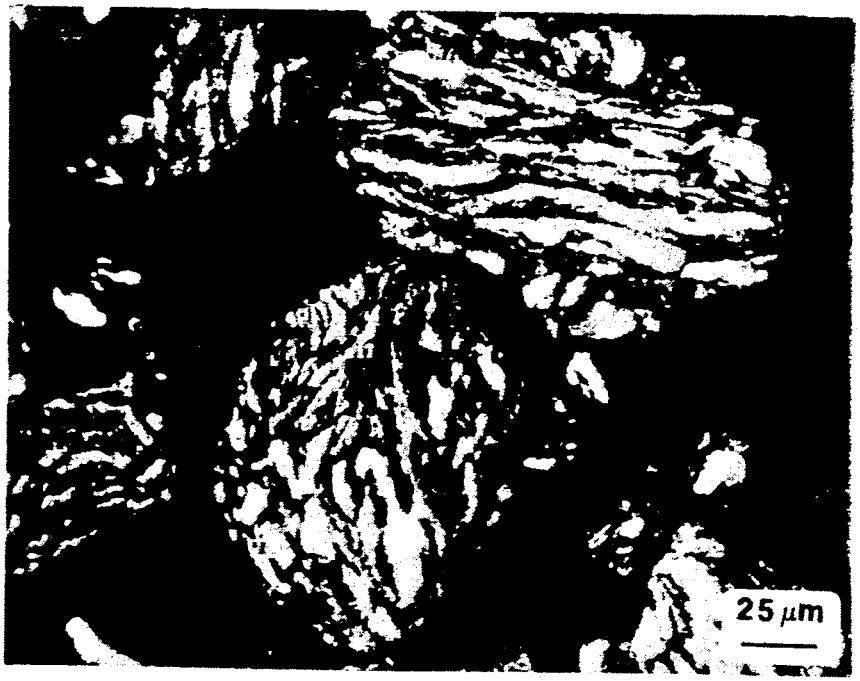

Zn), 1.02 at % Nd (5.6 wt. % Nd) hereinafter designated alloy A, was produced by comminuting rapidly solidified planar flow cast ribbon. The comminuted powder was added to either 0.26 grams or 0.88 grams of silicon carbide particulate corresponding approximately to 5 and 15 volume percent particulate reinforcement, respectively. The samples were processed in sequence by pouring them into a Spex Industries tungsten carbide vial (model #8004) containing two grinding balls. Each of the balls had a diameter of about 1.2 cm and was composed of tungsten carbide. The vials were then sealed and placed into a Spex Industries 8000 Mixer Mill. Each powder batch containing 5 and 15 volume percent SiC particulate was then processed for 60 minutes. The processing procedure described above provides a composite magnesium base alloy with silicon carbide particulate in the form of powder particles that exhibit a substantially uniform dispersion of reinforcement, and strong magnesium metal to silicon carbide particulate bonding. Photomicrographs of said composite powder particles containing 5 and 15 volume percent silicon carbide particulate that have been processed for 60 minutes are shown in FIGS. 1A and 1B.

EXAMPLE II

Figure 2A:
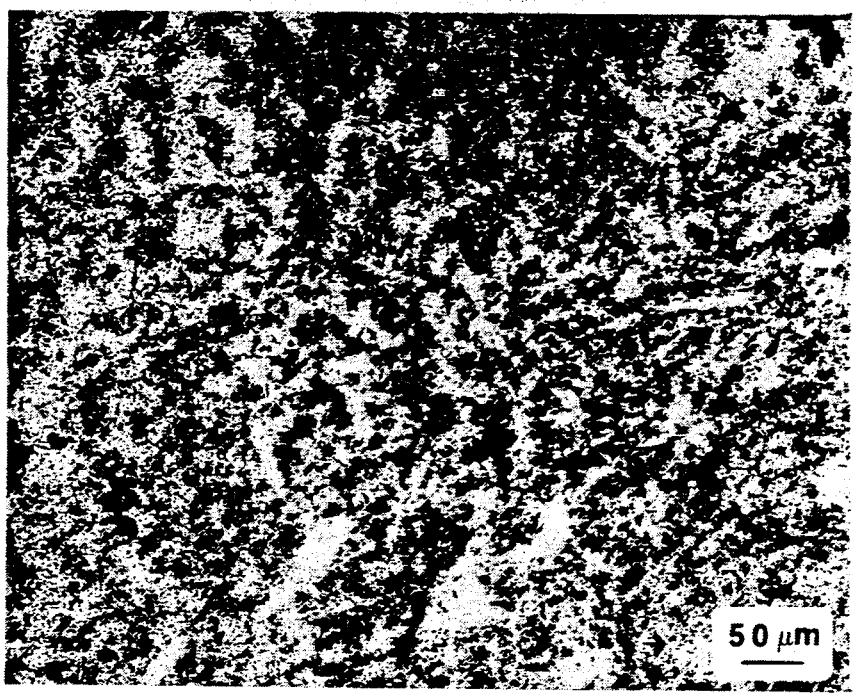
FIGS. 2A and 2B are photomicrographs of extruded magnesium based aluminum, zinc and neodymium containing, respectively, about 5 and 15 volume percent silicon carbide particulate.
Figure 2B:
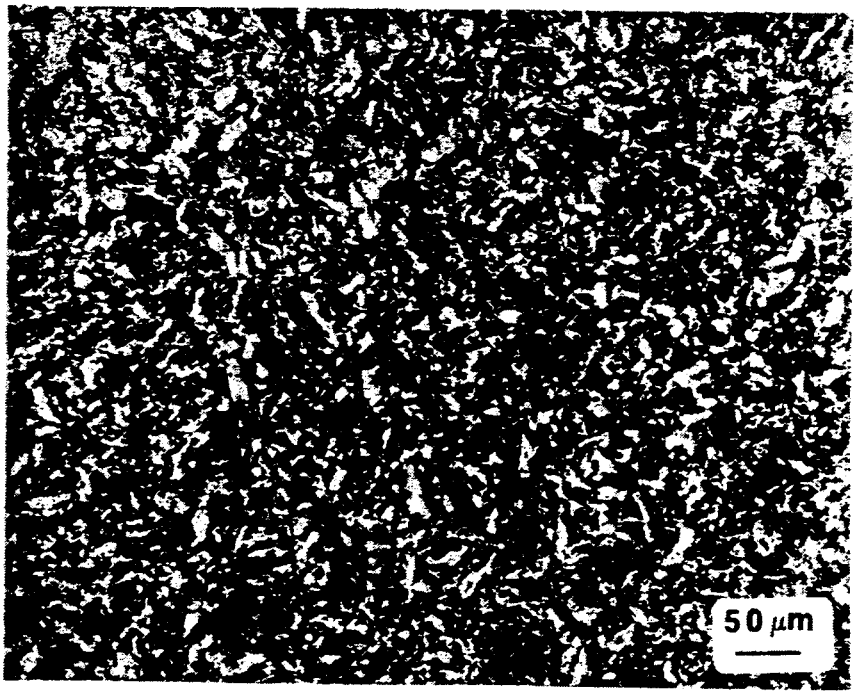

The procedure described above in Example I was used to produce two 200 gram batches of magnesium-based silicon carbide particulate composite powder particles. One of the batches contained 5 volume percent silicon carbide particulate reinforcement and the other contained 15 volume percent silicon carbide particulate reinforcement. For microstructural comparison, an additional batch of −40 mesh magnesium-base powder (alloy A) was blended using conventional techniques with 15 volume percent silicon carbide particulate. Each of the batches was then vacuum hot pressed into a billet having a diameter of 7.62 cm. The billets were heated to a temperature of 250° C. and extruded through alloy H-13 tool steel dies heated to a temperature of about 250° C. to form 1.59 cm diameter rods. As shown by the small dark spots in the photomicrographs of FIGS. 2A and 2B, for the 5 and 15 volume percent silicon carbide reinforced extrusions, respectively, processed in accordance to the procedure set forth in Example I, the silicon carbide particulate reinforcement is extremely fine and is distributed substantially uniformly throughout the magnesium-base matrix. The fineness and substantial uniformity of the particulate dispersion was not adversely affected or significantly enhanced by the extrusion.

Figure 3A:
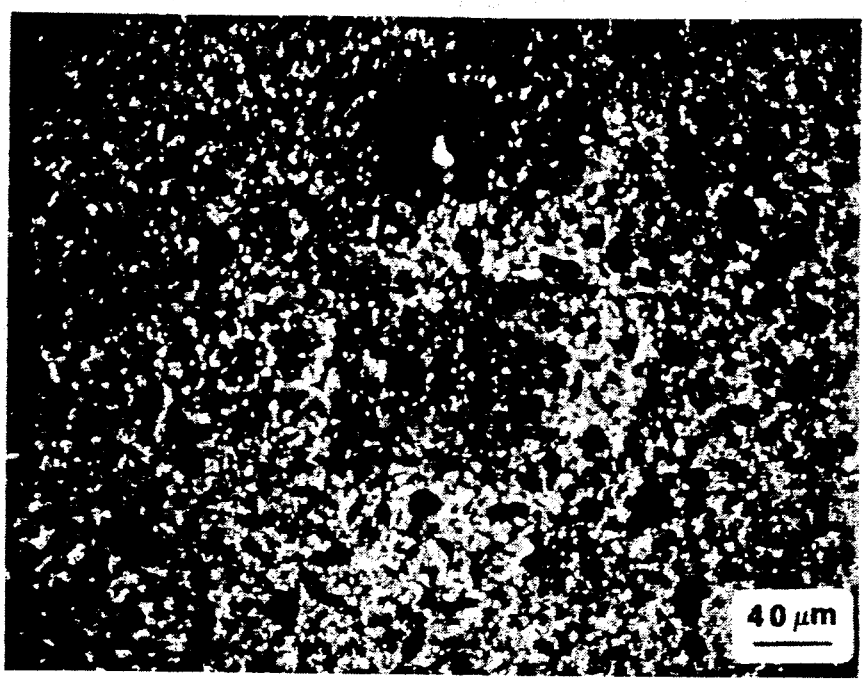
FIGS. 3A and 3B are scanning electron photomicrographs in a secondary electron imaging mode and silicon X-ray dot mapping mode, respectively, of extruded, rapidly solidified magnesium-base alloy (alloy A) reinforce 15 volume percent silicon carbide fabricated with the present invention.
Figure 3B:
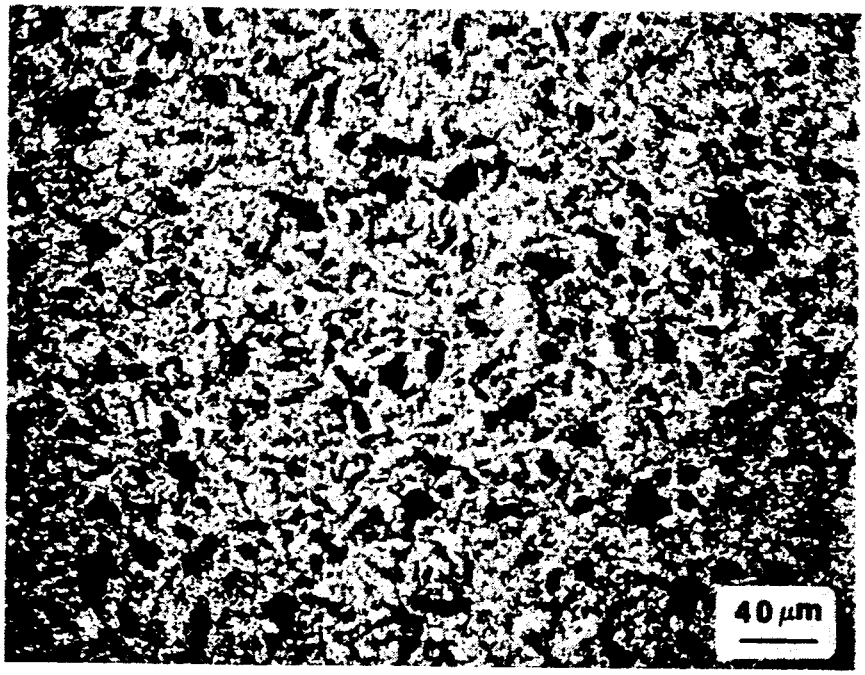
Figure 4A:
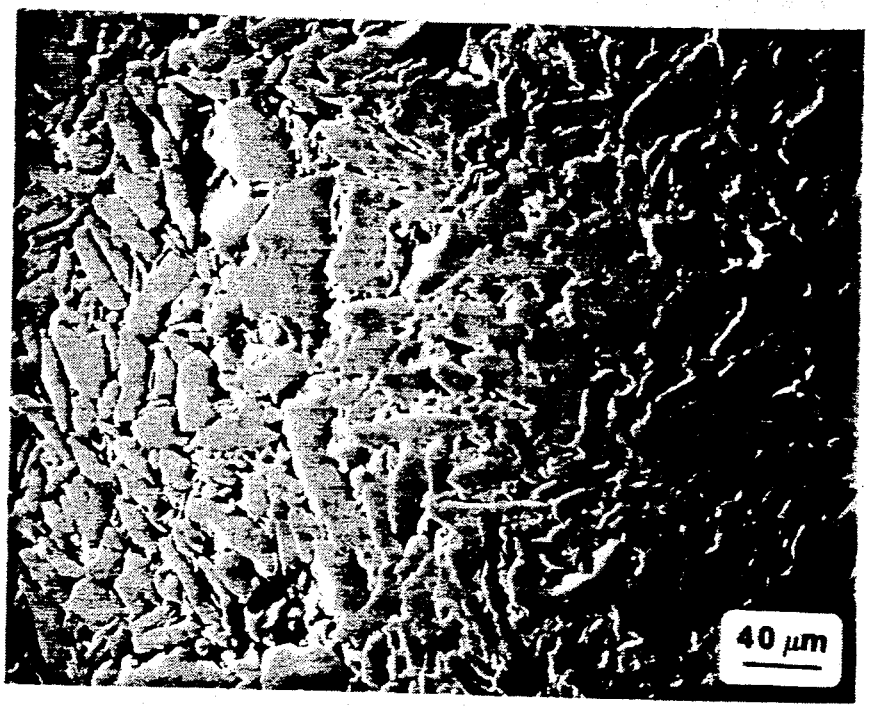
FIGS. 4A and 4B are scanning electron photomicrographs in a secondary electron imaging mode and silicon X-ray dot mapping mode, respectively, of extruded, rapidly solidified magnesium-based alloy (alloy A) blended using conventional techniques with 15 volume percent silicon carbide particulate.
Figure 4B:
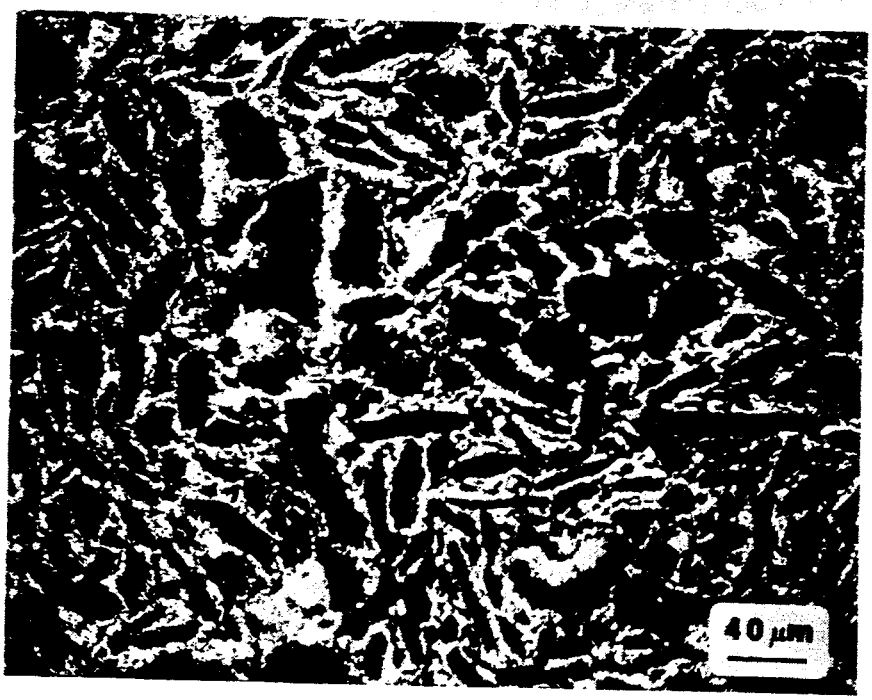

For comparison, scanning electron microscopy operating in a secondary electron imaging mode and silicon X-ray dot mapping mode was performed to indicate the distribution of silicon carbide in an extrusion of rapidly solidified magnesium-base alloy (alloy A) reinforced with 15 volume percent silicon carbide and fabricated in accordance to the procedures set forth above, and an extrusion of rapidly solidified magnesium-base alloy (alloy A) blended using conventional techniques with 15 volume percent silicon carbide particulate, and are shown in FIGS. 3 and 4, respectively. FIGS. 3A and 4A represent cross sections of the respective extrusions photographed using secondary electron imaging. FIGS. 3B and 4B represent the identical cross sectional position of the respective extrusions imaged using silicon X-ray dot mapping. As shown by the small white spots indicating Si rich areas in the photomicrographs of FIGS. 3B and 4B, for the extrusion of rapidly solidified magnesium alloy (alloy A) reinforced with 15 volume percent silicon carbide and fabricated in accordance to the procedures set forth above, and an extrusion of rapidly solidified magnesium-base alloy (alloy A) blended using conventional techniques with 15 volume percent silicon carbide particulate, respectively, the silicon carbide particulate reinforcement is distributed substantially more uniformly and on a finer scale throughout the magnesium-base matrix for the composite processed in accordance to the procedure set forth in Example I.

EXAMPLE III

Rods produced in accordance with the procedure described in Example II were subjected to tensile tests at room temperature to determine their tensile properties, including where measurable 0.2 percent tensile yield strength (Y.S.), ultimate tensile strength (U.T.S.), fracture strength (F.S.) and elongation (Elong.). Those tensile tests involving values of 0.2 percent yield strength, ultimate tensile strength, fracture strength and elongations were performed on an Instron Model 1125 tensile machine. For comparison, rods were extruded from alloy A, i.e., a rapidly solidified, monolithic magnesium-base alloy having the same composition and method of preparation as that set forth in Examples I and II (except that no particulate reinforcement was present and the powder was not ball milled). The rods were subjected to tensile tests in accordance with the procedure described above. The results of the tensile tests for rods containing particulate reinforcement (5 and 15 volume percent silicon carbide particulate reinforcement) as well as monolithic rods containing no particulate reinforcement (0 volume percent silicon carbide particulate reinforcement) are set forth in Table I.

As shown by the data of Table I, the addition of silicon carbide particulate to the rapidly solidified magnesium-base alloy (alloy A), processed by the procedures set forth in Examples I and II, results in an improvement in tensile strength compared to the monolithic rapidly solidified magnesium-base (alloy A) alloy. The data also indicates that strength may be further increased by increasing the silicon carbide volume percentage.

TABLE I

Room Temperature Tensile Properties for Extruded Rods of Magnesium-Base Material (i.e., alloy A) Containing 0, 5 and 15 Volume Percent Silicon Carbide Reinforcement

| Volume % Silicon Carbide Particulate | Y.S. (MPa) | U.T.S. (MPa) | F.S.* (MPa) | Elong. (%) |
|---|---|---|---|---|
| 0 | 472 | 509 | — | 10.7 |
| 5 | 504 | 534 | — | 1.6 |
| 15 | — | — | 535 | — |

*Alloy A containing 15 volume percent silicon carbide fractured in the elastic region of the stress-strain curve and did not have any measurable tensile ductility. A fracture (F.S.) strength for this material was determined.

EXAMPLE IV

Rods produced in accordance with the procedures described in Example II were subjected to room temperature ultrasonic techniques to measure the material Young's modulus (E), shear modulus (G) and Poisson's ratio ($\nu$). The technique, as described by A. Wolfenden in Acta Metallurgica, Vol. 25, pp. 823–826 (1977) the disclosure of which is hereby incorporated by specific reference thereto, and represents a dynamic modulus. For comparison, rods composed of alloy A, i.e., a rapidly solidified, monolithic magnesium-base alloy having the same composition and method of preparation as that set forth in Examples I and II (except that no particulate reinforcement was present and the powder was not ball milled) were also subjected to ultrasonic techniques to measure the materials of Young's modulus. The results of the ultrasonic measurements to determine the materials Young's modulus. The results of the ultrasonic measurements to determine the materials Young's modulus are set forth in Table II.

As shown by the data of Table II, the addition of silicon carbide particulate to the rapidly solidified magnesium-base alloy (alloy A), processed by the procedures set forth in Examples I and II, results in an improvement in Young's modulus and shear modulus compared to the monolithic rapidly solidified magnesium-base (alloy A) alloy. The data indicates that Young's modulus and shear modulus may be increased by increasing the silicon carbide volume percentage.

TABLE II

Room Temperature Young's Modulus (E), Shear Modulus (G) and Poisson's ratio (v) for Extruded Rods of Magnesium-Base Material (i.e., alloy A) Containing 0, 5 and 15 Volume Percent Silicon Carbide Reinforcement

| Volume % Silicon Carbide Particulate | E (MPa) | G (MPa) | $\nu$ (MPa) |
|---|---|---|---|
| 0 | 45.1 | 17.3 | 0.30 |
| 5 | 51.3 | 19.8 | 0.30 |
| 15 | 63.9 | 25.1 | 0.28 |

Having thus described the invention in rather full detail, it will be understood that such detail need not be strictly adhered to but that further changes and modification may suggest themselves to one skilled in the art, all falling within the scope of the invention as defined by the subjoined claims.

We claim:

1. A composite having a metal matrix and a reinforcing phase, said composite having been produced by a process comprising the steps of:
   (a) forming a charge containing as ingredients, a rapidly solidified magnesium base alloy and particles of a reinforcing material present in an amount ranging from about 0.1 to 50 percent by volume of said charge;
   (b) ball milling the charge energetically to enfold metal matrix material around each of said particles while maintaining the charge in a pulverulent state; and
   (c) consolidating said charge to provide a mechanically formable, substantially void-free mass.

2. A composite having at least 50 percent matrix material formed from a rapidly solidified magnesium based alloy, said matrix material having a microstructure comprised of a substantially uniform cellular network of solid solution phase ranging from 0.2 to 1.0 microns in size, together with precipitates of very fine, binary or ternary intermetallic phases which are less than 0.5 microns, and having substantially uniformly dispersed therein particles of a reinforcing material other than said precipitates.

3. A composite as recited in claim 2, wherein said reinforcing material is present in an amount ranging from about 5 to 15 percent by volume.

4. A composite as recited in claim 2, wherein matrix material is enfolded around each of said particles.

5. A composite as recited in claim 2, having the form of a powder.

6. A composite as recited in claim 2, having the form of a consolidated, mechanically formable, substantially void-free mass.

7. A composite as recited in claim 3, wherein said mass is selected from the group consisting of extrusions, forgings, rolled sheets or plates and drawn wire or tubes.

* * * * *